United States Patent [19]

Baer

[11] 4,443,902

[45] Apr. 24, 1984

[54] INVALID WALKER AND TRANSFER DEVICE

[76] Inventor: Richard K. Baer, 5576 N. Elston Ave., Chicago, Ill. 60630

[21] Appl. No.: 280,211

[22] Filed: Jul. 6, 1981

[51] Int. Cl.[3] ..... A61G 7/10; A61H 3/00

[52] U.S. Cl. ..... 5/81 B; 5/86; 272/70.4

[58] Field of Search ..... 272/70.3, 70.4; 297/5; 5/81 R, 81 B, 86, 83

[56] References Cited

U.S. PATENT DOCUMENTS 2,792,052 5/1957 Johannsen ..... 297/5

3,397,883 8/1968 Kiehn ..... 5/86

*Primary Examiner*—Alexander Grosz

*Attorney, Agent, or Firm*—W. A. Snow

[57] ABSTRACT

A motorized invalid walker and transfer device having an armpit lift lever. The lift arms are pivoted to a front stationary crossbar above a wheeled chassis, and the arms are actuated by a motorized-gear reduction device, the output of the shaft of which drives a jackscrew and a power tube connected at the opposite end to a transverse tube positioned forward of the first mentioned cross tube. The lift arms are automatically shifted in a gentle arc.

12 Claims, 11 Drawing Figures

INVALID WALKER AND TRANSFER DEVICE

SUMMARY OF THE INVENTION

The device hereof has a vertically-extending supporting bar anchored at its lower end to the front of a wheeled, horizontally-disposed chassis to which the ends of a pair of spaced, elongated lever arms are pivotally secured at the upper end thereof, a jackscrew and power tube positioned forwardly of said supporting rod to actuate the pair of lever arms about the lever arm pivots, a crutch pad on the free ends of each lever arm, and a motor and gear reducer assembly for actuating the jackscrew, means to control the operation of the jackscrew, and means to adjust the distance laterally between the fore ends of the lever arm and hence the crutch pads.

DETAILED DESCRIPTION OF THE DRAWINGS

Figure 1:
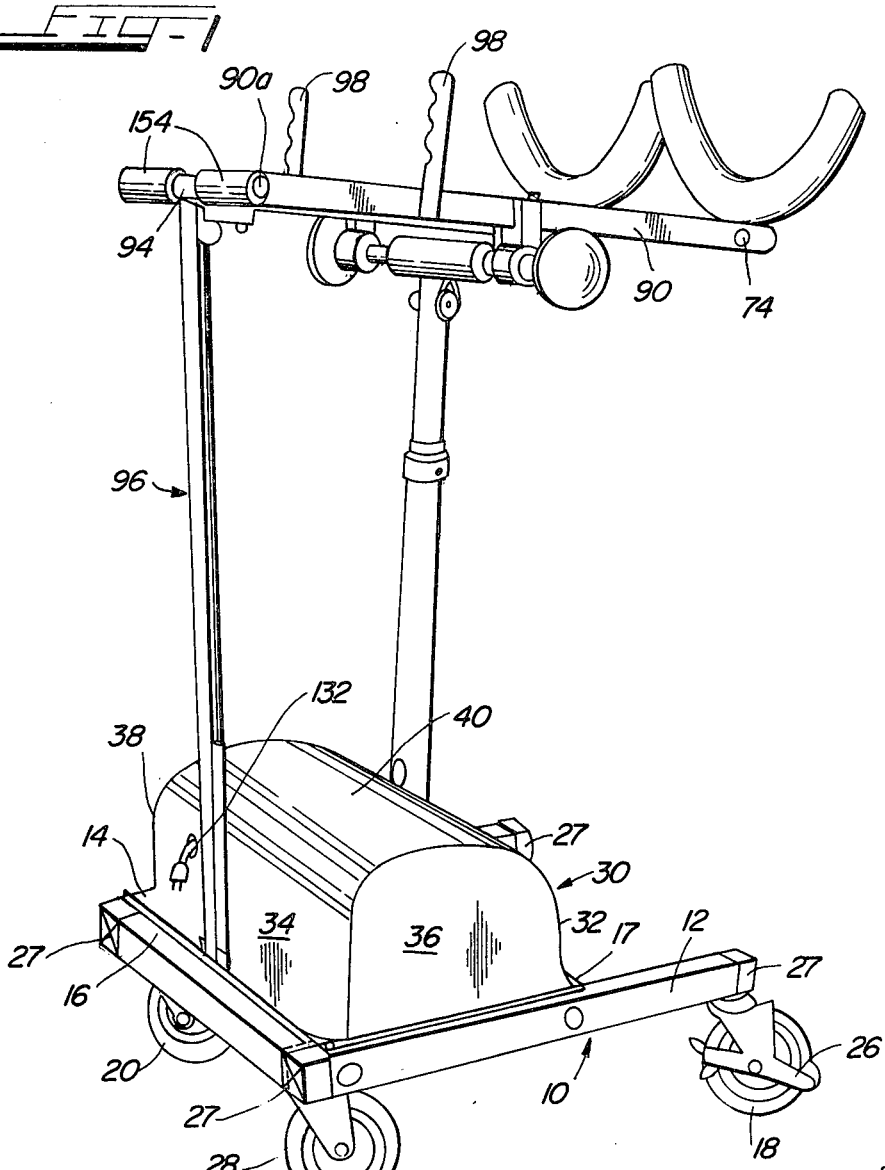
FIG. 1 is a perspective view of the present invention.
Figure 11:
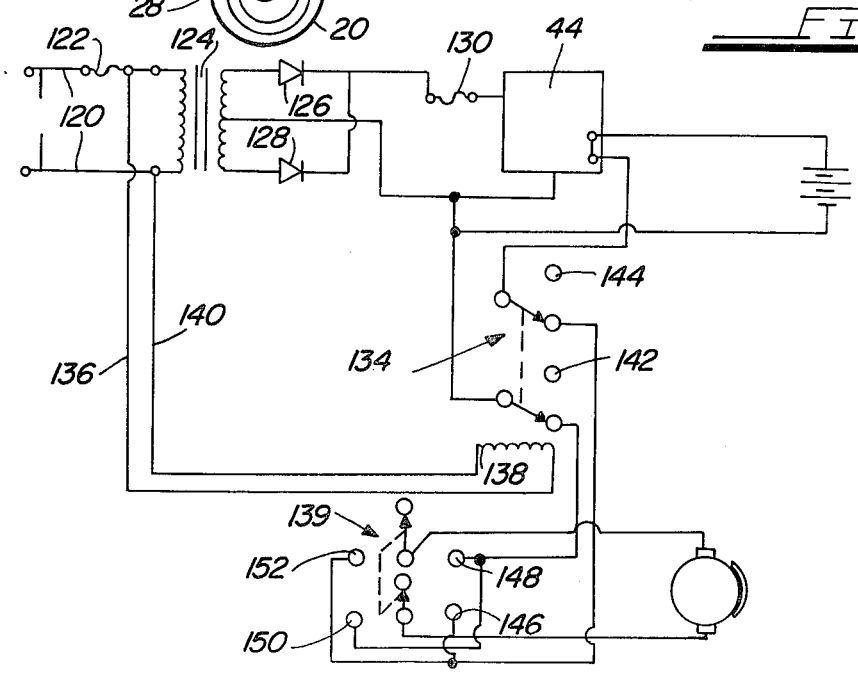
FIG. 11 is a circuit diagram and showing the battery charger.
Figure 2:
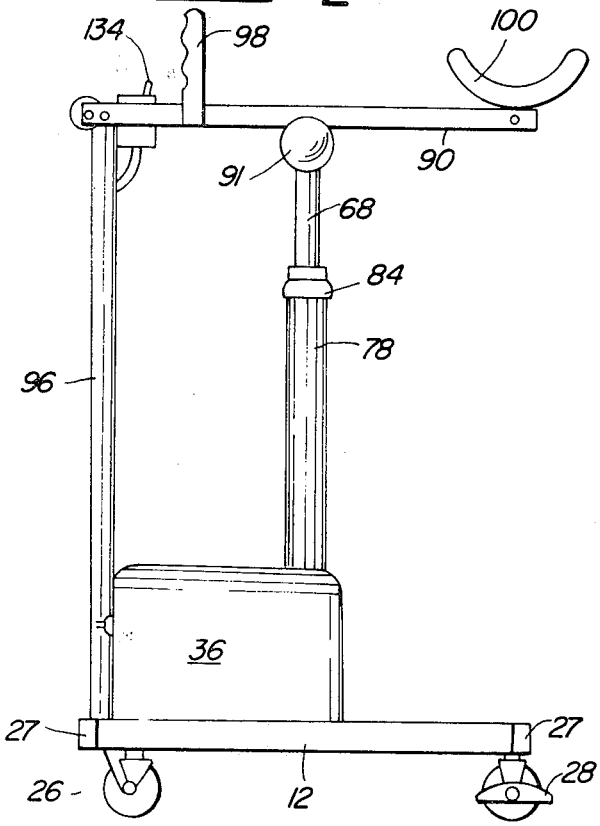
FIG. 2 is a side elevational view of the device of FIG. 1.

The device of the present invention comprises a rigid base 10 having a pair of side legs 12, 14, a front leg 16 and intermediate leg 17 anchored adjacent the rear ends of the side legs. These members are all square in cross-section bars of stainless steel. Pairs of rubber wheeled, nonmarking, ball bearing casters 18, 20 are mounted to the adjacent rear and front ends of the side legs 12, 14 and extend below said legs. Both front caster 18 are provided with brakes 26. The free ends of the side members 12, 14 are provided with plastic bumpers 27 at both the front and rear thereof.

A housing 30 comprises end walls 32, 34, side walls 36, 38, and an arcuate shaped top wall 40. The lower ends of the side walls 32, 34 and end walls 36, 38 are provided with outwardly-extending flanges to be anchored to the upper surface of the side legs 12, 14 by removable screws.

A bottom wall 42 is secured to the transverse legs 16, 17 adjacent the side legs 12, 14 to support a battery charger 44 and a recoil wheel 45 on which an electrical cord 43 is wound. Another bottom wall 47 is also anchored to transverse legs 16, 17 but adjacent side leg 12 to support a 12 volt battery 46. Solid square in cross-section spaced members 49, 51 are anchored to transverse members 16, 17.

The lower end of the jackscrew 64 is provided with a bevel gear 56 secured thereto by appropriate means and a bearing 54.

A reversible motor and gear reducer assembly 60 has a shaft connecting a worm gear 62 which meshes with bevel gear 56 for rotating the jackscrew 64 at about a 20 to 1 ratio. The jackscrew is provided with a power nut 66 secured in the power tube 68 so that when the jackscrew rotates clockwise or counterclockwise, the power tube will shift upwardly or downwardly. The motor, gear reducer assembly 60, bevel gear 56, bearing 54 and nut 58 are all enclosed in a housing 69.

Figures 6, 7, 8, 12, 13:
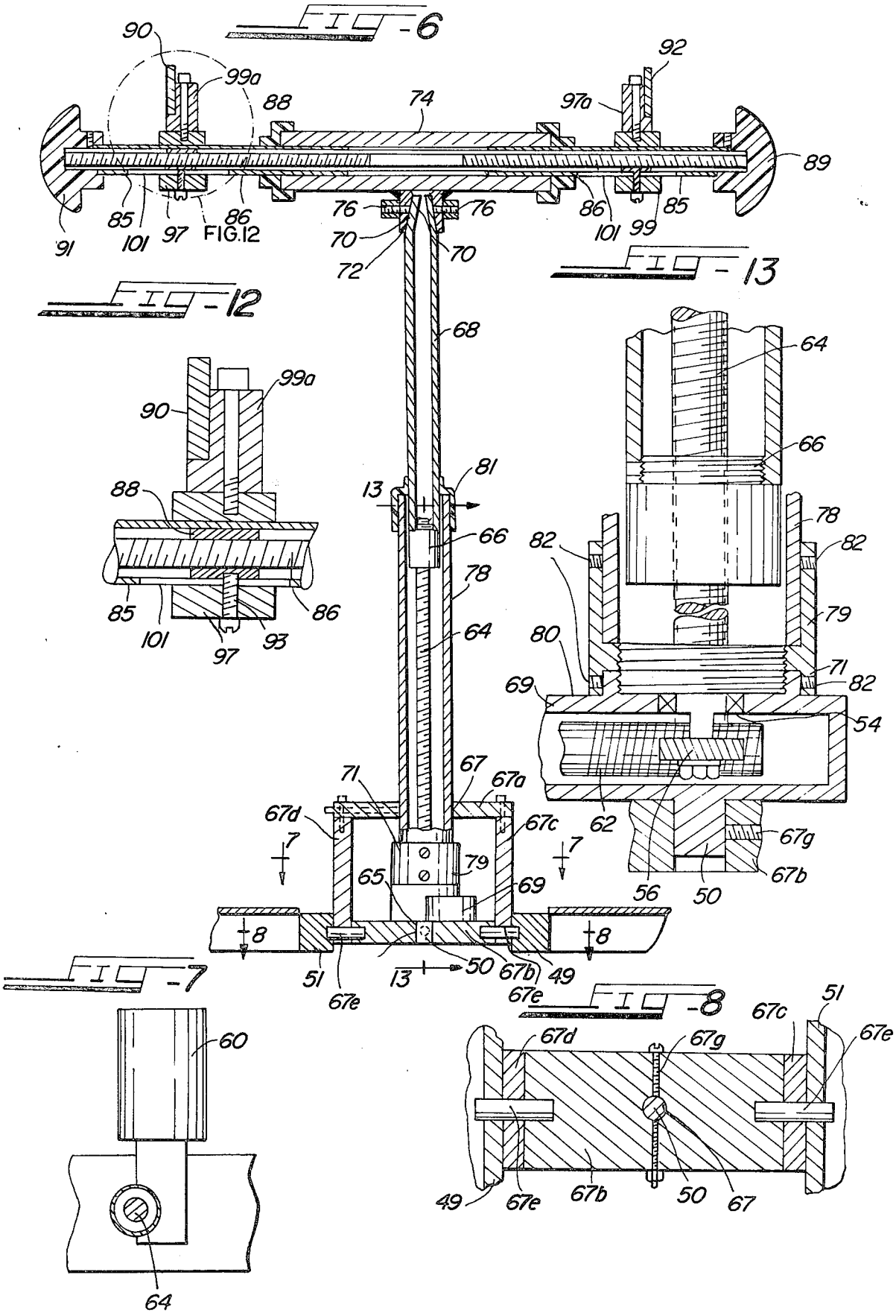
FIG. 6 is a vertical cross-sectional view through the jackscrew, the power arm and support therefor and the upper transverse arms.
FIG. 7 is a partial top plan view of the motor and gear assembly taken on the line 7—7 of FIG. 6.
FIG. 8 is a cross-sectional view taken on the line 8—8 of FIG. 6.
FIG. 12 is an enlarged cross-sectional view as shown in the circle of FIG. 6
FIG. 13 is a cross-sectional view taken on the lines 13—13 of FIG. 6.
Figure 9:
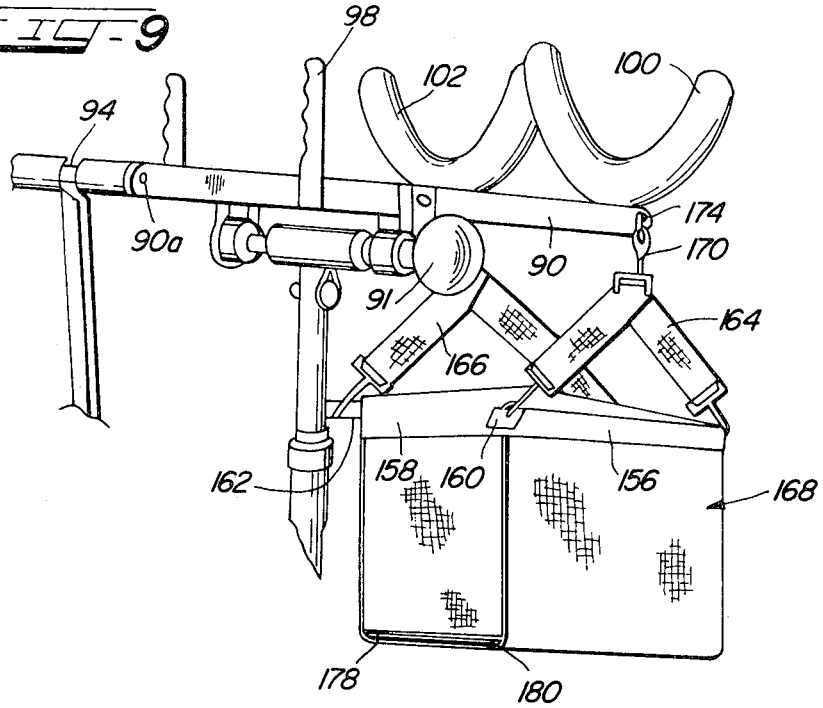
FIG. 9 is a perspective view showing the seat attachment and with parts broken away.

A cradle comprises a top leg 67*a*, a bottom leg 67*b* and side legs 67*c* and 67*d*. The side legs 67*c* and 67*d* are pivotally secured in legs 49, 51, respectively, by pins 67*e* so that the cradle is pivotally positioned therebetween. Top leg 67*a* is securely anchored to the upper ends of the side legs 67*c* and 67*d*, respectively, while the lower leg 67*b* is positioned between the legs 67*c* and 67*d* at their lower ends and securely anchored thereto. The legs are rectangular in vertical cross-section and are of stainless steel. The upper leg 67*a* is provided with an enlarged aperture 67 medially of the ends of plate 67*a* through which the lower ends of the cover tube 78 and the jackscrew 64 are inserted. See FIGS. 6 and 13. The lower end of the cover tube 78 is secured to the threads 79 in the upper end 71 of housing 69. The offset 50 seats in an aperture 67 medially of the ends of plate 67*b* and is anchored therein by bolt 67*g* extending across the plate 67*b*.

The upper end of the power tube 68 is tapered and seats in a taper 70 of the depending portion 72 and medially of the ends to an enlarged short tube 74 to which the upper end of the depending portion is welded. The depending portion 72 is drilled and tapped transversely for the reception of setscrews 76 to anchor the upper end of the power tube therein.

An enlarged, outer stainless steel tube 78 seats around the power rube 68. A collar 79 seats around the lower end of tube 78 and is positioned on seat 80 and anchored thereto, by setscrews 82 (see FIG. 13). A plastic collar 81 on the upper end of the outer tube 78 guides the upper end of the power tube 68.

The long threaded rod 86 seats medially in the tube 74 provided with right and left handed threads one on each end and extends outwardly of both ends of the tube 74. A cover tube 85 seats around the threaded rod 86 and supports a pair of spaced nuts 88 anchored therein by a screw 93 threaded in the lower end of the metal collars 97, 99 through elongated slots 101 in the lower end of the tube 85. The nuts 88 are then loosely anchored in the tube 85. The upper ends of the collars are each provided with integrally upstanding, spaced arms 92*a*, 99*a*, respectively, in which to seat the lever arms 90, 92, respectively, by welding. The ends of the tube 85 have plastic knobs 89, 91 thereon, respectively, to rotate the rod 86. It should be apparent that by rotating one knob, the levers 90, 92 will shift towards and away from each other depending on the rotational movement.

A pair of spaced, elongated, longitudinally-positioned levers 90, 92 are pivotally secured one to each of the ends of a transversely extending rod 94. The rod 94 is welded at its upper end to a vertically-extending fixed rod 96 medially of the ends of rod 94. The lower end of rod 96 is fixedly secured to the front leg 16 medially thereof.

Figure 3:
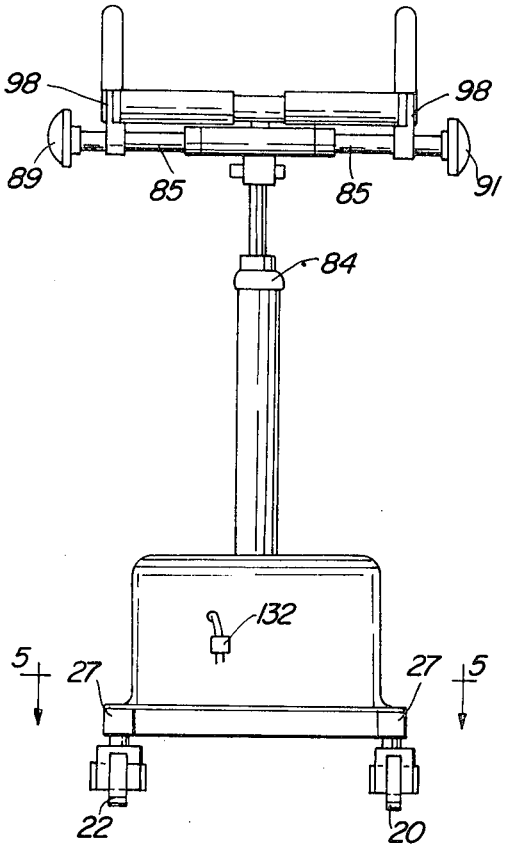
FIG. 3 is a front elevational view taken from the right hand side of FIG. 2.
Figure 4:
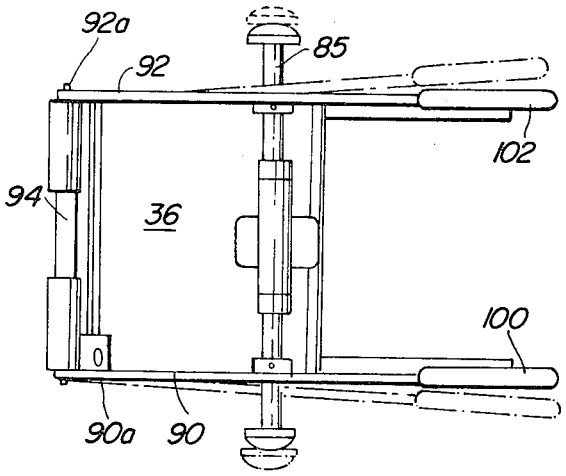
FIG. 4 is a top plan view of the device of FIGS. 2 and 3.
Figure 5:
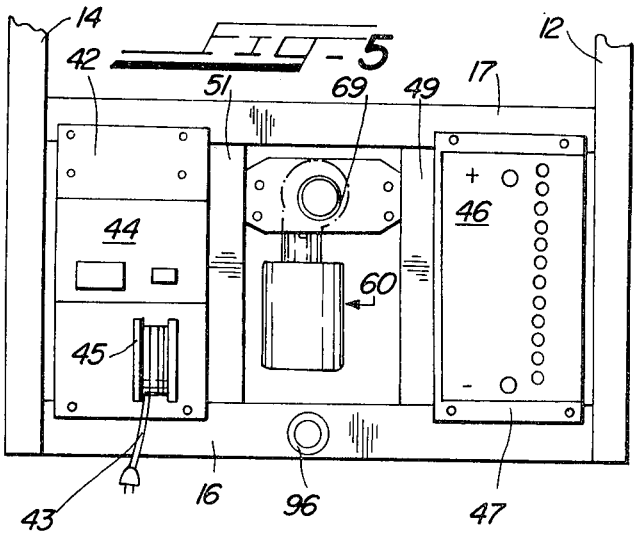
FIG. 5 is a cross-sectional view taken on the line 5—5 of FIG. 3 with the cover removed.

A pair of spaced, upstanding, cylindrical brackets 98 having hand grips thereon are fixedly secured one to each of the lever arms 90, 92 (see FIG. 3). The lower ends of the brackets 98 are secured to the lever arms 90, 92.

Rotation of the knobs 89, 91 will rotate the rod 85 to adjust the crutch pads 100, 102 on the free ends of the lever arms 90, 92 relative to the width of the patient's armpits for ease in raising the patient from sitting position to the vertical.

It should also be appreciated that the patient may rest his forearms on the concave pads 106, 108, respectively, which are relatively tight and pivotally and removably secured at 110 to the free ends of link arms 90, 92, and then simultaneously grasp the upright hand grips 112, 114, respectively. These grips are fixedly secured to the front end of the concave pads 106, 108, respectively.

Figure 10:
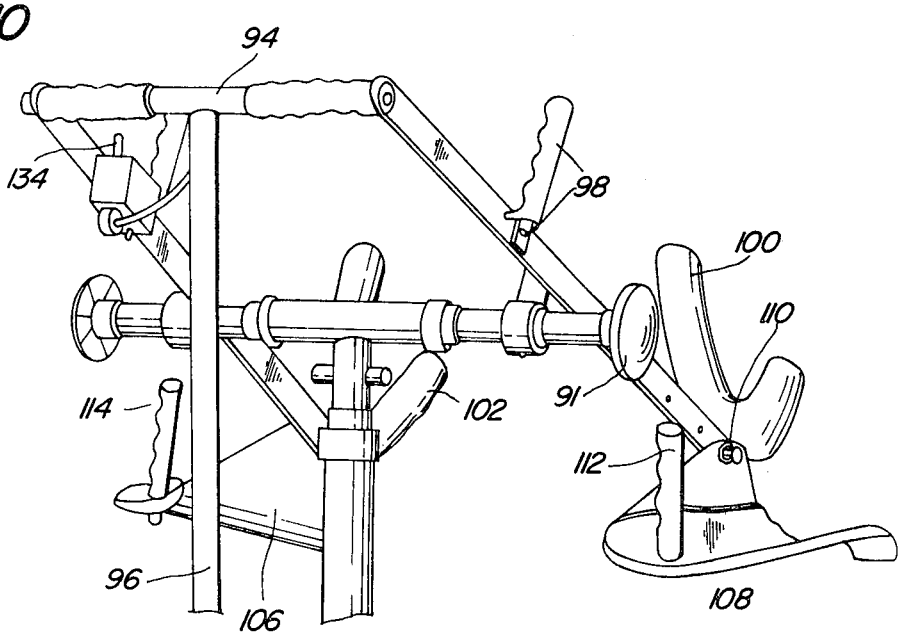
FIG. 10 is a perspective view of the upper end of the device and showing an arm rest.

If the forearm pads 106, 108 (see FIG. 10) are not used, the patient may grasp the upstanding hand grips on brackets 98.

To comply with the Underwriters' Code, when the battery is to be charged by plugging the electric plug 132 to the line current, such current will immediately flow through wire 136 to the solenoid 138 and thence back through the wire 140. The solenoid will cause the double pole, double throw relay switch 134 to move to the neutral contacts 142, 144, thus the switch 134 and the motor 60 will not operate while the battery is charging. However, the line current 120 will flow through the fuse 122 to the transformer 124, through diodes 126, 218 and the heat sensitive fuse 130 to the battery charger 44 and to the positive side of the battery. The negative side of the battery will allow the current to flow back to the transformer 124.

To operate, the deadman toggle switch 134 (a double pole, double throw) is shifted forwardly, i.e. to contacts 146, 148. The motor 60 will be energized to shift the lever arms 90, 92 upwardly through the jackscrew and power tube 68. To lower the lever arms, the toggle switch 134 is held down rearwardly causing the switch to move to contacts 150, 152 thereby reversing the field in the motor.

The structure of the present invention is constructed of stainless steel tubing and rods and adjustable to fit a patient within the height of four feet eleven inches to six feet six inches. It is also capable of supporting and transferring a patient weighing over six hundred pounds with minimal assistance.

It can be used as an easy and safe walker, and can transfer a patient from a bed (in sitting position) to a chair or to the commode area. Because the front ends of the side members 12, 14 are splayed outwardly, a patient can readily walk therebetween with ease for rehabilitating a patient through helping him to regain his ability to walk independently. It also reduces staff requirements by one person being able to help a patient rather than two. By using this unit, the nurses or aides can reduce their own back problems caused by lifting heavy patients.

In operation, the patient with a walking problem need only be raised to sitting position with the patient's legs over the side of the bed, or from a chair. The device of the present invention is rolled by the nurse or aide by using the handle grips 154 mounted on the crossbar or rod 94. By depressing the toggle switch forwardly or rearwardly, the motor will actuate the jackscrew 60 to rotate it clockwise or counterclockwise to raise or lower the lever arms 90, 92 and the crutch arm pads 100, 102 until the pads are under the armpits of the patient. The knobs 89, 91 are then also rotated to adjust the width of the crutch pads 100, 102 to fit the armpits of the individual patient. The patient then grips the hand grips 112, 114 on the forearm rests 106, 108 or the grips on brackets 98, as the case may be. By shifting the toggle switch rearwardly, the jackscrew will rotate clockwise to raise the power tube 68 and shift the lever arms 90, 92 about their pivots **90*a* and 92*a* to shift the arms and the crutch pads, and will lift the patient upwardly, very gently, until the patient is in vertical position. Now the patient may be moved anywhere away from the bed or chair, or may walk. It should be considered that the forepart of the side legs 12, 14 may extend under the bed or chair very readily. The nurse or aide will, of course, lock the casters with the latch brake 26 or 28** before raising the patient.

As an accessory, a sling 168 of strong fibers may be used. It comprises a pair of hems 156, 158 into which flat, stainless steel plates 160, 162 are inserted in the respective hems. V-shaped, double walled supporting strips 164, 166 are pivotally secured to the ends of plates 160, 162, respectively, each web supporting a sling 168. The straps 164, 166 are provided in each apex of both V-shaped webbings with lock hooks 170 for engagement with apertures 174 in the ends of the lever arms 72, 74, respectively. Of course, when this attachment is used, the forearm rests 106, 108 must be removed.

Also, the lower end of the sling 168 is also provided with stiff padded board 178, or other material, which is inserted in the pocket 180.

Another saddle identical to the above described saddle may have an enlarged aperture cut out medially in the saddle board and pocket, if it is desirable to place the patient in the saddle and on the commode.

It will be understood that details of the construction shown may be altered or omitted without departing from the spirit of the invention as defined by the following claims.

I claim:

1. A motorized device for raising an invalid from sitting position to standing position and for transporting comprising a frame having elongated, longitudinally-extending side legs, a front leg and a medial leg positioned transversely at one end of said frame and between said side legs, a vertically-extending rod secured medially to said front leg, a transverse rod secured medially to the upper end of said vertical rod, a pair of lever arms pivotally secured at one end to said rod, a cradle pivotally secured medially to said front and medial legs, a reversible motor and gear reducer assembly pivotally secured to said cradle, a housing surrounding said motor and gear reducer, a jackscrew affixed at one end to said gear reducer assembly, a bevel gear secured to the lower end of said jackscrew, a worm gear affixed to and extending from said motor and gear reducer assembly cooperating with said bevel gear, a power rod, a nut affixed therein and cooperating with said jackscrew for extending and contracting said power tube, an enlarged tube affixed at one end to said housing, an interiorly-threaded short tube affixed medially to the upper end of said power rod, a pair of threaded rods positioned one in each end of said short threaded tube, a knob on the free ends of said threaded tube for rotating said rods, a pair of collars affixed one to each link arm forwardly of said first mentioned transverse rod and depending therefrom, said threaded rods supported in said collars, crutch arms with crutch pads on the distal end of said lever arms, a reversible battery, and switch means to establish an electric circuit from said battery to said motor and gear reducer assembly to raise and lower said power tube and said lever arms.

2. The device according to claim 1 wherein a pair of spaced, longitudinally-extending bars extend into said transverse bars, a platform affixed between each of said longitudinally-spaced bars and the respective side leg for supporting a battery on one platform and a battery charger on the other platform.

3. The device according to claim 2 wherein the lower end of said jackscrew extends into the cradle and said cradle is pivoted to and between said pair of spaced longitudinal bars.

4. The device according to claim 3 wherein said cradle comprises four plates, a top and bottom plate and a pair of side plates secured together in rectangular configuration, and the lower end of said side plates pivotally secured to said spaced longitudinal bars, aligned apertures in the top and bottom plates medially of the ends thereof, an axially depending rod on said housing to seat in an aperture in the bottom plate, and the lower end of the jackscrew seats in and through the aperture in said top plate.

5. The device according to claim 3 wherein the lower end of said jackscrew is secured to a bevel gear, a worm gear being secured to the shaft of said gear reducer and meshing with said bevel gear to rotate said jackscrew.

6. The device according to claim 3 wherein said motor and gear reducer assembly are mounted in said housing and suspended between said side walls of said cradle.

7. The device according to claim 6 wherein an elongated tube loosely surrounds said jackscrew having an upper and lower end, and shorter than said jackscrew, a collar secured to the upper end of said tube.

8. The device according to claim 1 wherein said lever arms are each provided with an adjustable hand grip.

9. The device according to claim 1 wherein a concave padded forearm rest is pivotally secured to one of each of the lever arms below the crutch pads, a vertically-positioned hand grip being secured to the end of said rest forward of said pivot.

10. A motorized device for lifting and transporting an invalid from a sitting position to a standing position comprising:

(a) a base frame having a pair of spaced, longitudinally-extending, elongated side legs, a transversely-extending rear leg connecting said side legs together at the front end thereof, a second transversely-extending leg affixed medially from the ends of said side legs to said side legs forwardly of said front leg, a pair of short, longitudinally-extending spaced legs secured to said transversely-extending legs;

(b) a platform fixed to said side leg and the adjacent spaced, short, longitudinally-extending leg;

(c) a battery charger affixed to said platform;

(d) a second platform affixed to the other side leg and the remaining short leg;

(e) a battery secured to said latter platform;

(f) a cradle pivotally secured between said spaced short legs;

(g) a vertically-extending tube secured at one end medially at one end of said rear transverse leg;

(h) a transversely-extending rod secured medially to the other end of said vertical tube;

(i) a pair of spaced lever arms each pivotally secured at one end to the free ends of said latter tube;

(j) a padded crutch pad secured to the free ends of said lever arms;

(k) a reversible motor and gear reducer assembly secured in said cradle and extending outwardly thereof;

(l) a jackscrew affixed at one end to said motor and gear reducer assembly;

(m) a tube surrounding said jackscrew and containing a fixed nut therein adjacent the upper end thereof for cooperating with said jackscrew;

(n) a power tube secured at one end to said nut and extending upwardly therefrom;

(o) an enlarged, tansverse, short tube secured medially to the upper end of said power tube, and axially bored and threaded at each end;

(p) a pair of threaded rods secured one in each end of said enlarged tube, and having hand knobs on the free ends thereof for rotating said threaded rods;

(q) a pair of collars affixed to and each depending from one of said lever arms to support said threaded rods;

whereby said threaded rods, upon manipulation of said knobs, shift said lever arms inwardly or outwardly laterally;

(r) switch means on one of said lever arms connecting to said battery to establish an electric circuit for the motor and operate said gear assembly and jackscrew and power arm to push or pull said lever arms upwardly or downwardly about the lever arm pivot.

11. The device of claim 10 wherein concave forearm pads each containing a pivot are pivotally secured one to each of said lever arms below said crutch pads, a vertically extending hand grip being secured to the ends of said pads forwardly of said pivot.

12. The device according to claim 10 wherein a sling is removably secured and depends from the distal ends of said lever arms whereby to transport an invalid in sitting position.

* * * * *